US009469921B2

(12) United States Patent
Olde Weghuis et al.

(10) Patent No.: US 9,469,921 B2
(45) Date of Patent: Oct. 18, 2016

(54) ARTIFICIAL GRASS FIBRE AND ARTIFICIAL LAWN COMPRISING SUCH A FIBRE

(75) Inventors: Marinus Hendrikus Olde Weghuis, Oldenzaal (NL); Frederik Jan van der Gaag, Nijverdal (NL)

(73) Assignee: TEN CATE THIOLON B.V., Nijverdal (NL)

( * ) Notice: Subject to any disclaimer, the term of this patent is extended or adjusted under 35 U.S.C. 154(b) by 692 days.

(21) Appl. No.: 13/144,334

(22) PCT Filed: Jan. 14, 2010

(86) PCT No.: PCT/NL2010/000004

§ 371 (c)(1),
(2), (4) Date: Jul. 13, 2011

(87) PCT Pub. No.: WO2010/082816

PCT Pub. Date: Jul. 22, 2010

(65) Prior Publication Data

US 2011/0262665 A1 Oct. 27, 2011

(30) Foreign Application Priority Data

Jan. 14, 2009 (NL) ..... 1036418

(51) Int. Cl.

| | |
|---|---|
| ***E01C 13/08*** | (2006.01) |
| ***D01D 5/253*** | (2006.01) |
| ***D06N 7/00*** | (2006.01) |

(52) U.S. Cl.

CPC ..... *D01D 5/253* (2013.01); *D06N 7/0065* (2013.01); *E01C 13/08* (2013.01); *Y10T 428/23957* (2015.04); *Y10T 428/23993* (2015.04)

(58) Field of Classification Search

CPC .. D01D 5/253; D02G 3/445; D01B 2505/02; Y10S 273/13; E01C 13/08; Y10T 428/23957; Y10T 428/23393; D06N 7/0065

USPC ..... 428/17, 397, 400, 92, 97

See application file for complete search history.

(56) References Cited

U.S. PATENT DOCUMENTS

| | | | |
|---|---|---|---|
| 3,837,980 | A | 9/1974 | Nishimura et al. |
| 3,940,522 | A | 2/1976 | Wessells |

(Continued)

FOREIGN PATENT DOCUMENTS

| | | | |
|---|---|---|---|
| CN | 202730374 | U * | 2/2013 |
| EP | 0432272 | A1 | 6/1991 |

(Continued)

OTHER PUBLICATIONS

Google Patents translation of CN 202730374 U, Feb. 2013.*

(Continued)

*Primary Examiner* — Cheryl Juska
(74) *Attorney, Agent, or Firm* — Hoffmann & Baron, LLP

(57) ABSTRACT

The invention relates to a synthetic monofilament fiber for use in an artificial lawn, said synthetic fiber having a width greater than the thickness of the synthetic fiber and being provided with solid thickened parts at its free ends, and a central part between the thickened parts comprising a curved section and having a substantially uniform thickness, seen in transverse direction, the synthetic fiber having a thickness/width ratio such that the synthetic fiber can buckle locally upon being subjected to an external load. The invention further relates to an artificial lawn with a backing to which one or more synthetic fibers according to the invention are attached.

17 Claims, 5 Drawing Sheets

(56) References Cited

U.S. PATENT DOCUMENTS

| | | | | |
|---|---|---|---|---|
| 4,176,150 | A | 11/1979 | Bromley et al. | |
| 4,416,934 | A * | 11/1983 | Kimura et al. | 442/195 |
| 4,472,477 | A * | 9/1984 | Phillips | 442/193 |
| 4,735,825 | A | 4/1988 | Friedrich | |
| 5,268,229 | A * | 12/1993 | Phillips et al. | 428/400 |
| 5,811,040 | A | 9/1998 | Mallonee | |
| 5,922,462 | A | 7/1999 | Kent et al. | |
| 5,958,527 | A | 9/1999 | Prevost | |
| 6,426,140 | B1 * | 7/2002 | Phillips et al. | 428/375 |
| 6,680,353 | B1 * | 1/2004 | Kato | C08K 3/22 524/497 |
| 6,753,082 | B1 * | 6/2004 | Lobovsky et al. | 428/397 |
| 7,939,144 | B2 * | 5/2011 | Verleyen | 428/17 |
| 2001/0033902 | A1 | 10/2001 | Seaton | |
| 2003/0044607 | A1 * | 3/2003 | Yuuki | D01F 6/62 428/395 |
| 2003/0216095 | A1 * | 11/2003 | Basalik | 442/118 |
| 2005/0203258 | A1 * | 9/2005 | Kimura | D01F 6/625 525/450 |
| 2006/0093783 | A1 | 5/2006 | De Clerck | |
| 2006/0159917 | A1 * | 7/2006 | Verleyen | 428/364 |
| 2009/0098378 | A1 * | 4/2009 | Spaans et al. | 428/397 |
| 2012/0114942 | A1 | 5/2012 | Emge et al. | |
| 2013/0273268 | A1 * | 10/2013 | Luijkx | 428/17 |

FOREIGN PATENT DOCUMENTS

| | | | |
|---|---|---|---|
| EP | 0530489 | A1 | 3/1993 |
| EP | 2284318 | A1 | 2/2011 |
| GB | 1390338 | | 4/1975 |
| JP | 49-103722 | | 12/1947 |
| JP | 52-165981 | | 1/1951 |
| JP | 50-24871 | | 3/1975 |
| JP | 50-24872 | | 3/1975 |
| JP | 49-103722 | U | 9/1975 |
| JP | 02-240303 | A | 9/1990 |
| JP | 05-025806 | A | 2/1993 |
| JP | 07-082704 | | 3/1995 |
| JP | 2001-248013 | A | 9/2001 |
| KR | 10-1989-0002109 | B1 | 6/1989 |
| KR | 10-2000-0075669 | | 12/2000 |
| KR | 100957866 | B1 * | 5/2010 |
| WO | 98/38359 | A1 | 9/1998 |
| WO | 01/61110 | A1 | 8/2001 |
| WO | 0198589 | A2 | 12/2001 |
| WO | 02/00973 1 | | 1/2002 |
| WO | 2005/005730 | A1 | 1/2005 |
| WO | 2005/005731 | A1 | 1/2005 |
| WO | 2005111281 | A1 | 11/2005 |
| WO | 2005124028 | A1 | 12/2005 |
| WO | 2006/085751 | A1 | 8/2006 |
| WO | 2009/005375 | A1 | 1/2009 |
| WO | 2010/082816 | A1 | 7/2010 |
| WO | WO 2011027235 | A1 * | 3/2011 |

OTHER PUBLICATIONS

English Translation of JP50-24872.
Korean Office Action, issued Apr. 1, 2016 in Korean Application No. 10-2011-7015416.

* cited by examiner

ARTIFICIAL GRASS FIBRE AND ARTIFICIAL LAWN COMPRISING SUCH A FIBRE

CROSS-REFERENCE TO RELATED APPLICATIONS

This application is the National Stage of International Application No. PCT/NL2010/000004, filed Jan. 14, 2010, which claims the benefit of Netherlands Application No. NL 1036418 filed Jan. 14, 2009, the contents of which is incorporated by reference herein.

FIELD OF THE INVENTION

The invention relates to a synthetic fibre of the monofilament type for use in an artificial lawn, which synthetic fibre has a width greater than the thickness of the synthetic fibre.

BACKGROUND OF THE INVENTION

The invention also relates to an artificial lawn consisting at least of a backing to which one or more synthetic fibres according to the invention are attached.

Many sports, such as field hockey, tennis, American football, etc, etc, are currently played on artificial lawn as described in the introduction, comprising synthetic fibres as described in the introduction. Although sports people sustain fewer injuries when falling, making sliding tackles etc on natural grass sports fields, on account of the soft playing surface of natural grass, such sports fields sustain a great deal of damage precisely as a result of their intensive usage, in particular for the above sports, and as a result of the varying influence of the weather conditions.

Artificial lawns, on the other hand, require less maintenance and can be played on much more intensively than natural grass sports fields. Partly because of this, the synthetic fibres must have specific properties in order to be able to withstand the loads to which they are subjected as a result of being played on more intensively.

A drawback of the synthetic fibres that are currently known is that they tend to assume a flat orientation relative to the ground surface during use. This results in so-called "bare patches" in the artificial lawn and thus in an increased risk of injuries, etc.

This problem can be eliminated in part, for example by providing a granular infill material, such as sand or granules of a plastic material, between the synthetic fibres. The presence of these infill granules leads to a more upright orientation of the artificial glass fibres. Additionally, the infill granules not only provide a softer, shock-absorbing and thus less injury-prone surface. Furthermore, they lead to an improved style of play, so that the style of play on the artificial lawn will resemble the style of play on natural grass as much as possible.

The use of an infill in artificial lawns has a number of drawbacks. Not only is the installation of such an artificial lawn more labour-intensive than the installation of a natural lawn, but an artificial lawn provided with an infill requires subsequent maintenance as well. The initially uniform distribution of the granular infill can be disturbed by intensive usage. As a result, patches containing hardly any infill can develop in particular at places where the artificial lawn is played on very intensively, for example in the goal area, which has an adverse effect on the quality of play, but which above all leads to an increased risk of injury.

Another solution for the above-described problem is to increase the stiffness of the monofilament, which can be done by changing the chemical composition and/or the processing method. This is undesirable, however, because it will lead to a more abrasive artificial lawn with an increased risk of injuries.

Another solution for the problem as described above is to adapt the geometry of the synthetic fibre, for example as proposed in US 2001/033902 or in WO 2005/005730. Both patents disclose fibres comprising stiffness-enhancing agents. However, on account of the geometry of the fibre and the location of the stiffness-enhancing agents, a synthetic fibre is obtained which exhibits an increased risk of splitting and/or fracture due to material stresses that may develop in the fibre, for example caused by loads exerted thereon during play or temperature changes.

It is furthermore noted in this regard that US 2001/033902 discloses a composite filament fibre (also called multifilament) which, on account of its geometry and the orientation of the stiffness-enhancing agents, intentionally creates weak lines of fracture in the composite fibre. The fibre is intended to split so as to create multiple filament fibres.

Similar weak artificial fibres that are prone to splitting and/or fracture are disclosed in WO 2005/005730. Said publication, too, discloses a fibre comprising stiffness-enhancing agents, but said fibre, on account of its geometry, has undesirable points or lines of fracture at which undesirable material stresses can develop, for example under the influence of loads being exerted thereon during play (sliding tackles, etc.) or temperature changes.

WO 2005/005731 shows fibre geometries of synthetic fibres having an irregular cross-section. Due to the presence of thickened (or narrowed) parts (so-called "spines" or "buckles"), a concentration of material stresses will inevitably take place when loads are exerted thereon, which may lead to fracture or splitting.

U.S. Pat. No. 3,940,522 furthermore shows a fibre geometry in which the synthetic fibre is centrally provided with a thickened part, which thickened part is moreover located on one side of the fibre. Upon distortion, said fibre geometry will inevitably lead to undesirable material stresses, resulting in a buildup and concentration of material stresses at the location of the thickened part. Because of this, the fibre according to U.S. Pat. No. 3,040,522 is very prone to fracture and splitting and, unlike the fibre according to the invention, will not "buckle".

WO 2006/085751 likewise shows all kinds of fibre geometries in which the synthetic fibre will not buckle upon being subjected to loads but rather fracture or split due to an undesirable concentration of material stresses.

SUMMARY OF THE INVENTION

The above fibre geometries therefore have a shorter life than the fibre according to the invention. In addition to that, the thickened part at the ends makes the fibre according to the invention more sliding-friendly, so that players in the field which sustain fewer injuries.

The object of the present invention is precisely to prevent such a weak synthetic fibre which remains prone to splitting and fracture and to provide an improved synthetic fibre for use in an artificial lawn which is sufficiently rigid yet flexible as well and which has the capacity to straighten again so as to be able to take up the varying loads during play, and which is also sufficiently wear-resistant and sliding-friendly, so that the fibre will less tend to assume a flat orientation or split or fracture, and which furthermore does not increase the risk of injury or have an adverse effect on the playing characteristics.

According to the invention, the synthetic fibre is characterised in that the synthetic fibre has a curved section and a thickness/width ratio such that the synthetic fibre will buckle locally upon being subjected to an external load. In this way unnecessary distortion of the fibre—as in the aforesaid prior art fibres—is prevented, so that the fibre will have a longer life and fracture or splitting of the fibre is prevented.

According to the invention, the synthetic fibre is provided with a thickened part at its free ends, seen in transverse direction, so as to enhance its stiffness and straightening capacity. More particularly, said thickened part is round so as to make the fibre more sliding-friendly, whilst also the transition from the synthetic fibre to the thickened part is curved so as to prevent undesirable splitting of the fibre.

In principle, the synthetic fibre according to the invention has a high flexural stiffness, which flexural stiffness will disappear when the fibre is subjected to a specific load, enabling the fibre to buckle (and spring back).

More specifically, the fibre according to the invention has a curved section, with the bending radius of the curved section ranging between 0.3 mm and 0.7 mm, more particularly between 0.45 mm and 0.65 mm.

According to the invention, in order to realise a fibre exhibiting a desired flexural stiffness but also a certain degree of flexibility so as to be able to take up the loads during play, the thickness of the synthetic fibre ranges between 0.05 mm and 0.15 mm.

Furthermore, the width of the synthetic fibre preferably ranges between 0.5 mm and 1.5 mm.

More specifically, the synthetic fibre has an omega shape, so that the inclusion of moisture will be possible, making the artificial lawn more user-friendly and reducing the risk of injury, for example when making sliding tackles.

The fibre is preferably made of polyolefin or polyamide, more in particular of polypropylene or polyethylene or a copolymer, or a blend of one or more of the above polymers.

BRIEF DESCRIPTION OF THE DRAWINGS

The invention will now be explained in more detail with reference to a drawing, in which.

For a better understanding of the invention, like elements will be indicated by the same numerals in the description of the figures below.

DETAILED DESCRIPTION OF PREFERRED EMBODIMENTS

Figure 1:
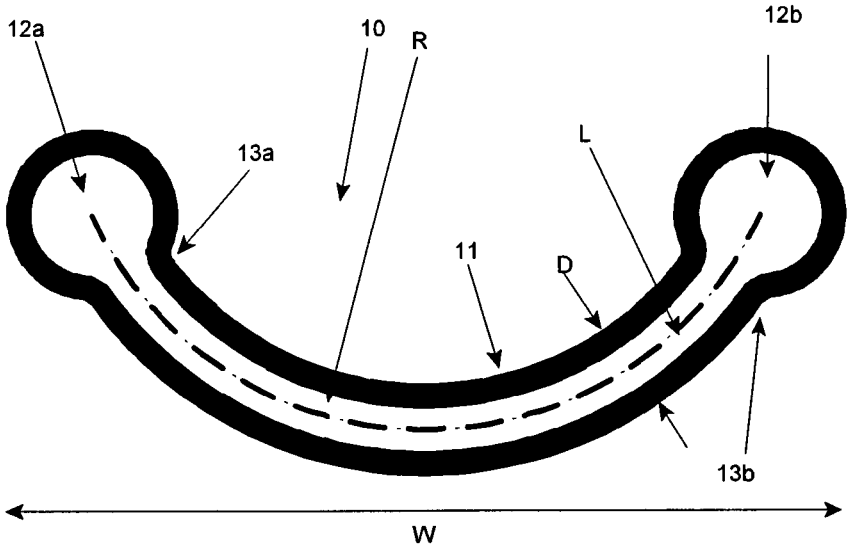
FIGS. 1, 2, and 4 show different embodiments of an artificial grass sports fibre according to the invention.

In FIG. 1, reference numeral 10 indicates a first embodiment of a synthetic fibre according to the invention.

The synthetic fibre 10 is preferably a monofilament obtained by means of an extrusion process. As is clearly shown in FIG. 1, the width W is greater than the thickness D of the fibre 10 (in particular of the central part 11).

As FIG. 1 clearly shows, the fibre 10 has a curved shape with a bending radius R of between 0.3 mm and 0.7 mm. Said bending radius R in particular ranges between 0.45 mm and 0.65 mm.

Figure 4:
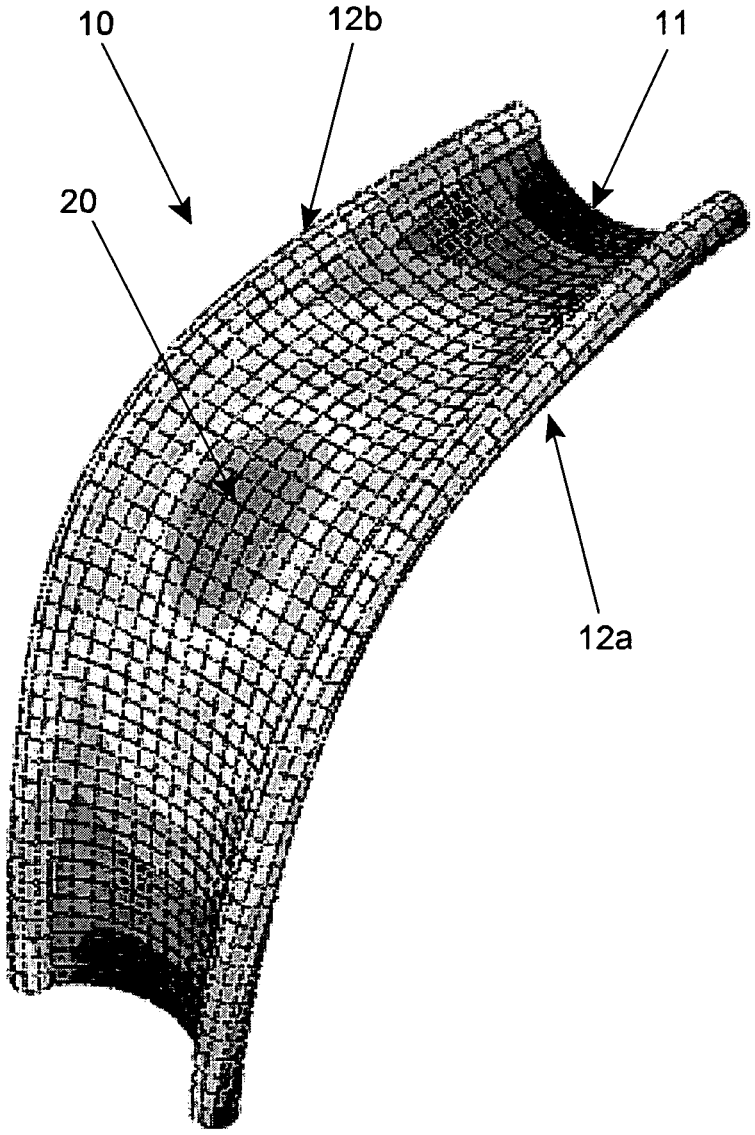
Figure 5:
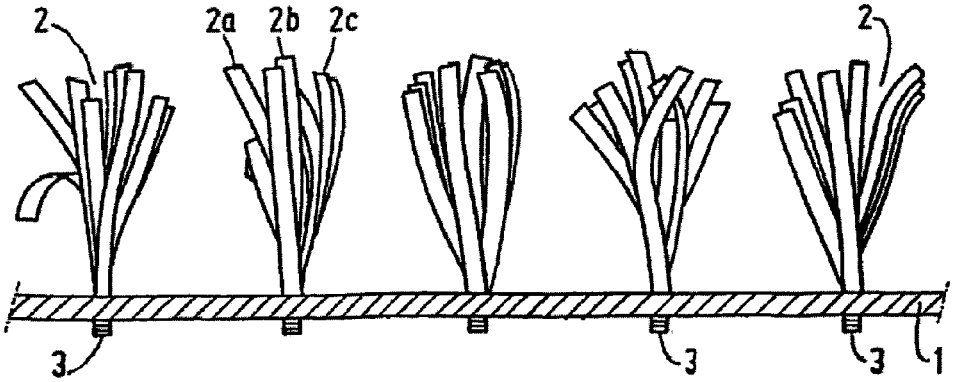
FIGS. 5 and 6 schematically show a few embodiments of an artificial lawn comprising a synthetic fibre according to the invention.

According to the invention, the fibre characteristics are such that it not only is sufficiently reveliant/flexible, but that it also has a flexural stiffness such that it will not unnecessarily assume a flat orientation in the artificial lawn (artificial grass sports field) of which the fibre 10 forms part (see FIGS. 4 and 5).

A drawback of a synthetic fibre having a relatively high flexural stiffness is that players who play on an artificial lawn comprising such "stiff" synthetic fibres do not consider the field very player-friendly. In particular, such a "stiff" synthetic fibre will sooner lead to injuries, in particular when sliding tackles are made thereon.

On the other hand, a flexible fibre will tend to assume a flat orientation during play on the artificial lawn, as a result of which the fibre's functionality as regards the playing characteristics of the lawn will be lost. Because said flat fibres, hard "bare" patches will form in the field, which are also harmful to the players and which increase the risk of injury. Accordingly it is an object of the invention to provide a solution in this regard, and according to the invention the fibre described hereinafter has a width/thickness ratio such that the fibre 10 will no longer bend but buckle locally upon being subjected to a specific external load during use of the artificial lawn.

This prevents the synthetic fibre from being unnecessarily subjected to flexural stresses. Excessive material stresses can develop in the synthetic fibre when it is being bent, in particular when the synthetic fibre is flattened by a person walking or playing on the artificial lawn or by objects such as chairs, tables or platforms being placed thereon.

The flexural stresses produce a creep effect in the synthetic material of the synthetic fibre. Said creep effects result in undesirable distortion of the fibre, resulting in a permanent flat orientation of the fibre in the artificial grass sports field.

This phenomenon is prevented with the synthetic fibre according to the invention because the synthetic fibre will not bend (and consequently will not distort undesirably) upon being subjected to external loads but rather buckle locally.

Local buckling of the synthetic fibre under the influence of an external load prevents local material distortions in the fibre, which will permanently change the shape of the fibre (viz. its flat orientation), or splitting of the fibre as a result of said undesirable material stresses.

Since the synthetic fibre 10 according to the invention will locally buckle under the influence of an external load, it retains its elasticity or straightening capacity, resulting in significantly improved playing characteristics of the artificial grass sports field.

More specifically, the synthetic fibre is characterised in that the buckling effect will occur at a minimum bending radius of 2 mm and a maximum bending radius of 10 mm. In other words, the width/thickness ratio of the fibre must be such that it will not directly buckle upon being subjected to an external load, since this would mean that the fibre would be lacking in resilience and would immediately assume a flat orientation.

Essential is that according to the invention the synthetic fibre must be capable of moving the synthetic material in the direction of the neutral line L when bending of the fibre occurs when the fibre is subjected to an external load. In this way the occurrence of undesirable material stresses in the fibre is prevented, which stresses might result in distortion of the fibre, which would have an undesirable effect on the functionality both of the fibre and of the artificial lawn.

Reference L indicates the neutral line of the synthetic fibre, in which regard it is noted that identical amounts of synthetic material are present on either side of the neutral line L.

The synthetic fibre must preferably be made of polypropylene, polyethylene or polyamide or a copolymer, or of a blend of one or more of the aforesaid polymers, and the selection of the synthetic material must be such that the synthetic fibre will at all times remain within the elastic distortion range upon distortion under the influence of an external load. A synthetic (co)polymer has a viscous and an elastic range, and the transition between the two ranges is indicated as the so-called "yield point". It is also possible to form the synthetic fibre of a blend of the aforesaid materials.

Figure 3:
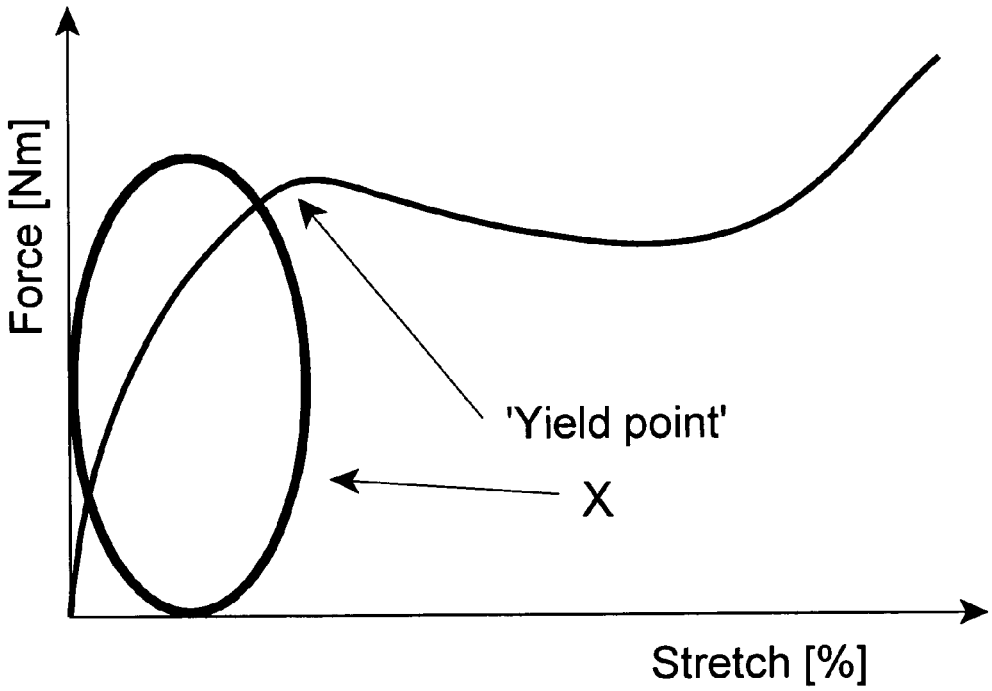
FIG. 3 shows a diagram.

In possible embodiments of the synthetic fibre, the fibre may therefore be made of rubber, which is permanently elastic synthetic polymer, or of a synthetic (co)polymer which will remain within the elastic range upon being subjected to a load and which preferably has a high "yield point". The need for such a synthetic fibre having such a geometry is shown in FIG. 3, which is a diagram showing the extension of the synthetic fibre plotted as a percentage on the horizontal axis against the force exerted on the synthetic fibre or the synthetic polymer.

It is desirable that the synthetic fibre thus loaded remain entirely within the elastic range indicated by reference X in the diagram.

The thickness of the synthetic fibre, indicated by reference D, preferably ranges between 0.05 mm and 0.15 mm, preferably between 0.08 mm and 0.10 mm. The width of such a fibre in that case ranges between 0.5 mm and 2.5 mm, preferably between 1.0 mm and 1.5 mm. It has been found that such a width-thickness ratio, with the fibre preferably being made of polyethylene, exhibits the above-described effect, with the fibre not distorting permanently under the influence of an external load but buckling locally, which buckling must therefore take place within the elastic range indicated by reference X in FIG. 3.

As is clearly shown in FIG. 1, the synthetic fibre 10 comprises thickened parts 12*a*-2*b* on its sides (seen in transverse direction), which thickened parts are preferably round. The synthetic fibre according to the invention thus not only has non-sharp side edges, which has a positive effect on the playing characteristics, in particular with a view to preventing injuries to players when making sliding tackles or falling, but which also imparts additional resilience to the fibre, which has a positive effect on the straightening capacity of the fibre.

Also here it should be noted that the thickened parts are evenly distributed relative to the neutral line L.

The thickness of the thickened parts 12*a*-12*b* preferably ranges between 0.15 mm and 0.35 mm, more in particular between 0.20 mm and 0.25 mm. It is also noted that the transition 13*a*-13*b* between the central part 11 and the thickened parts 12*a*-12*b* must be curved in order to prevent undesirable material stresses at that location and consequently undesirable splitting of the fibre.

Figure 2:
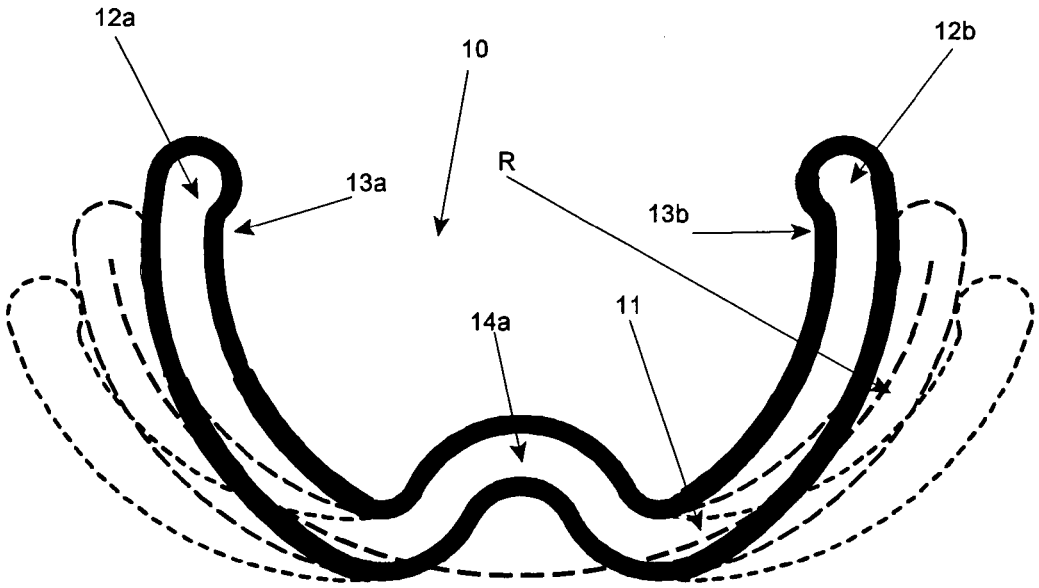

FIG. 2 shows another, alternative embodiment, in which the synthetic fibre has an omega shape, seen in sectional view, the "belly" of which omega is indicated by reference numeral 14*a*.

As is clearly shown in FIG. 2, such an omega-shaped fibre 10 exhibits a functional resilience upon being loaded externally. As a result of the suitable width-thickness ratio, as described above, in combination with the specific omega geometry, the omega fibre 10 has a functional elasticity which enables the fibre to spring back under the influence of loads, on the other hand, the omega geometry provides a certain flexural stiffness, which opposes mechanical distortion of the synthetic material, however, and, conversely, causes the synthetic fibre to buckle locally.

At rest, the synthetic fibre shown in FIG. 2 has an omega-shaped fibre geometry, and an overall curved or bent configuration with a bending radius R.

Such a situation is shown in FIG. 4, which shows the synthetic fibre 10 according to FIG. 1, and more in particular the mechanical stresses in the material that occur as a consequence of an external load being exerted on the fibre. The figure clearly shows the central area 20 in which buckling takes place.

Figure 6:
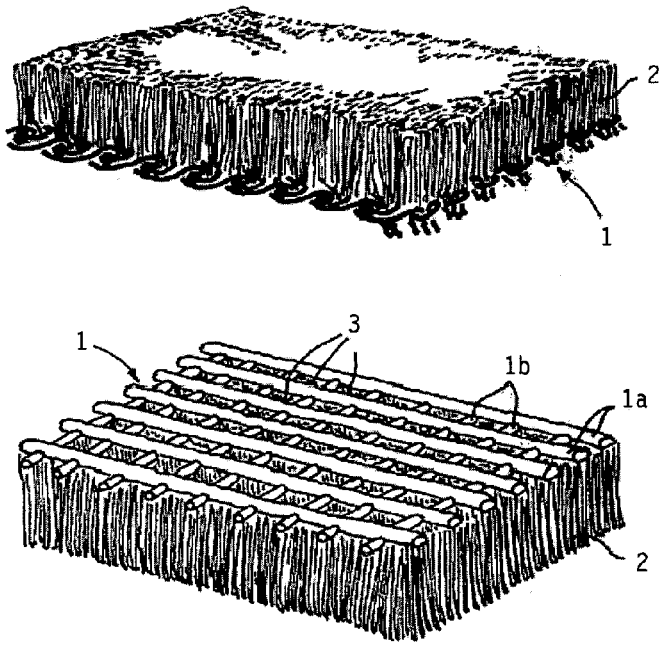

FIGS. 5 and 6 show a few embodiments of an artificial lawn, in which a synthetic fibre according to the invention can be used. In both figures the artificial lawn comprises a backing 1, to which several synthetic fibres 2 (corresponding to the fibres 10 shown in FIGS. 1, 2 and 3) are attached at the locations indicated by reference numeral 3, for example by tufting. The extruded synthetic fibre 2 may be individually attached to the backing 1 or in a bundle of, for example twined, fibres 2*a*-2*c*.

In another embodiment, as shown in FIG. 6, the synthetic fibre according to the invention may be a monofilament. Also in this embodiment several monofilaments may be twined to form a bundle, after which each bundle is attached to the backing 1. In FIG. 6 the backing has an open structure and is composed of a grid of supporting yarns 1*a*-1*b*, to which the synthetic fibres 2 are attached.

What is claimed is:

1. A synthetic monofilament fibre for use in an artificial lawn, said synthetic fibre, in cross-section, having a width greater than a thickness of the synthetic fibre and being provided with solid thickened parts at free ends of the cross-section, and a central part between the thickened parts comprising a curved section having a substantially uniform thickness, and wherein said thickened parts are round.

2. A synthetic fibre according to claim 1 wherein the bending radius of the curved section ranges between 0.3 mm and 0.7 mm.

3. A synthetic fibre according to claim 1 wherein the thickness of the synthetic fibre ranges between 0.05 mm and 0.15 mm.

4. A synthetic fibre according to claim 1 wherein the width of the synthetic fibre ranges between 0.5 mm and 1.5 mm.

5. A synthetic fibre according to claim 1 wherein the synthetic fibre is made of polyolefin or polyamide.

6. An artificial lawn comprising a substrate to which one or more synthetic fibres according to claim 1 are attached.

7. A synthetic fibre according to claim 1, wherein the bending radius of the curved section ranges between 0.45 mm and 0.65 mm.

8. A synthetic fibre according to claim 5, wherein the synthetic fibre is made of polypropylene or polyethylene.

9. A synthetic monofilament fibre for use in an artificial lawn, said synthetic fibre, in cross-section, having a width greater than a thickness of the synthetic fibre and being provided with thickened parts at free ends of the cross-section, and a central part between the thickened parts comprising an omega shaped section having a substantially uniform thickness.

10. A synthetic fibre according to claim 9 wherein the bending radius of the curved section ranges between 0.3 mm and 0.7 mm.

11. A synthetic fibre according to claim 9 wherein the thickness of the central part of the synthetic fibre ranges between 0.05 mm and 0.15 mm.

12. A synthetic fibre according to claim 9 wherein the width of the synthetic fibre ranges between 0.5 mm and 1.5 mm.

13. A synthetic fibre according to claim 9 wherein the synthetic fibre is made of polyolefin or polyamide.

14. An artificial lawn comprising a substrate to which one or more synthetic fibres according to claim 9 are attached.

15. A synthetic fibre according to claim 10, wherein the bending radius of the curved section ranges between 0.45 mm and 0.65 mm.

16. A synthetic fibre according to claim 13, wherein the synthetic fibre is made of polypropylene or polyethylene.

17. An artificial lawn comprising a substrate to which one or more synthetic fibres are attached, the synthetic fibres having thickened parts at the ends of the cross-sectional thickness and an omega shape in cross section.

* * * * *